US009936799B2

(12) United States Patent
Reyes

(10) Patent No.: US 9,936,799 B2
(45) Date of Patent: Apr. 10, 2018

(54) BROOM HOLDER

(71) Applicant: Ruben Dario Reyes, Yonkers, NY (US)

(72) Inventor: Ruben Dario Reyes, Yonkers, NY (US)

( * ) Notice: Subject to any disclaimer, the term of this patent is extended or adjusted under 35 U.S.C. 154(b) by 0 days.

(21) Appl. No.: 14/879,486

(22) Filed: Oct. 9, 2015

(65) Prior Publication Data

US 2016/0249735 A1 Sep. 1, 2016

(51) Int. Cl.
*A46B 17/02* (2006.01)

(52) U.S. Cl.
CPC ..... *A46B 17/02* (2013.01); *A46B 2200/302* (2013.01)

(58) Field of Classification Search
CPC ..... A47L 13/512; A46B 17/02; B25G 3/00; B25G 3/04
USPC ..... 248/110, 111, 113; 15/146, 159.1; 211/65
See application file for complete search history.

(56) References Cited

U.S. PATENT DOCUMENTS 2,441,982 A * 5/1948 Turner ..... A47L 13/51 248/113
3,981,399 A * 9/1976 Crouch ..... B44D 3/123 206/15.2
6,629,616 B1 * 10/2003 Heinzle ..... A47B 47/00 211/85.7
7,044,299 B2 * 5/2006 Nagoya ..... A46B 17/04 206/361
8,567,616 B2 * 10/2013 Mishan ..... A47L 13/20 211/70.6
2004/0158951 A1 * 8/2004 Smith ..... A47L 13/20 15/247
2005/0229348 A1 * 10/2005 Jones ..... A46B 17/02 15/168
2016/0235271 A1 * 8/2016 Zhu ..... A47L 13/10

* cited by examiner

*Primary Examiner* — Todd M Epps
(74) *Attorney, Agent, or Firm* — Myron Greenspan, Esq.; Lackenbach Siegel LLP

(57) ABSTRACT

A broom holder for supporting a broom includes a stand-alone base having a flat support surface suitable for resting on a floor. Two generally parallel walls extend from the base in a direction away from and normal to the base. The parallel walls are spaced from each other a distance generally corresponding to a width of a broom head and forms an elongate space to receive the broom head and bristles. The parallel walls are configured to engage and support the broom head to maintain the broom in an upright orientation with the broom handle in a generally vertical direction and at a height at least equal to the predetermined length of the broom bristles so that the broom can be supported when not in use without bending or flexing the bristles.

16 Claims, 6 Drawing Sheets

BROOM HOLDER

BACKGROUND OF THE INVENTION

1. Field of the Invention

The invention generally relates to brooms, and, more specifically, to brooms and broom holders for storing brooms when not in use.

2. Description of Related Art

Storing and protecting brooms and the broom bristles when the broom is not in use has been challenging. Typically, when a broom is not in use it is placed on the floor and the weight of the broom rests on the bristles. This frequently and permanently, over time, deforms the bristles or bends them as a result of resting on the floor and renders them less effective. In such cases, such storage of brooms results in premature damage requiring replacement of the brooms, at extra costs to the consumer.

BRIEF DESCRIPTION OF THE INVENTION

A broom holder for storing a broom when it is not in use. The stored broom will then be able to stand in a vertical position and be stable because of such a base. This broom holder will help the broom remain in its place.

With this broom holder, a broom can be safely stored in a vertical manner off the floor and without risk of bending the bristles, as a result of resting the broom on the floor. This specially designed broom holder or storage caddy provides neat, compact and orderly storage of a broom, which helps to keep a home neat, organized, and aesthetically-appealing. It also keeps the bristles straight while being stored to prevent damage to the bristles.

BRIEF DESCRIPTION OF THE DRAWINGS

Those skilled in the art will appreciate the improvements and advantages that derive from the present invention upon reading the following detailed description, claims, and drawings, in which:

DETAILED DESCRIPTION

Figure 1:
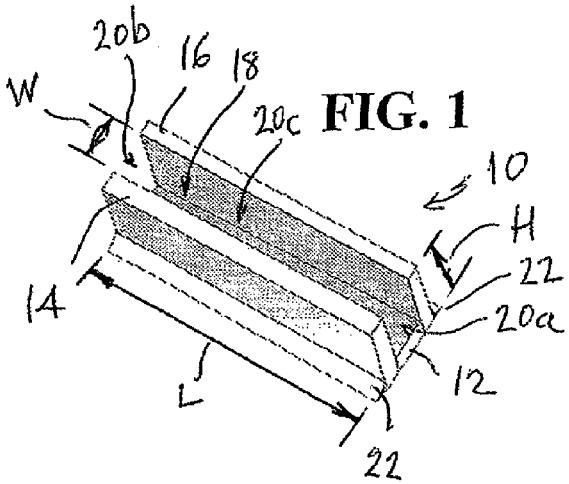
FIG. 1 is a perspective view of a broom holder in accordance with the invention.
Figure 1A:
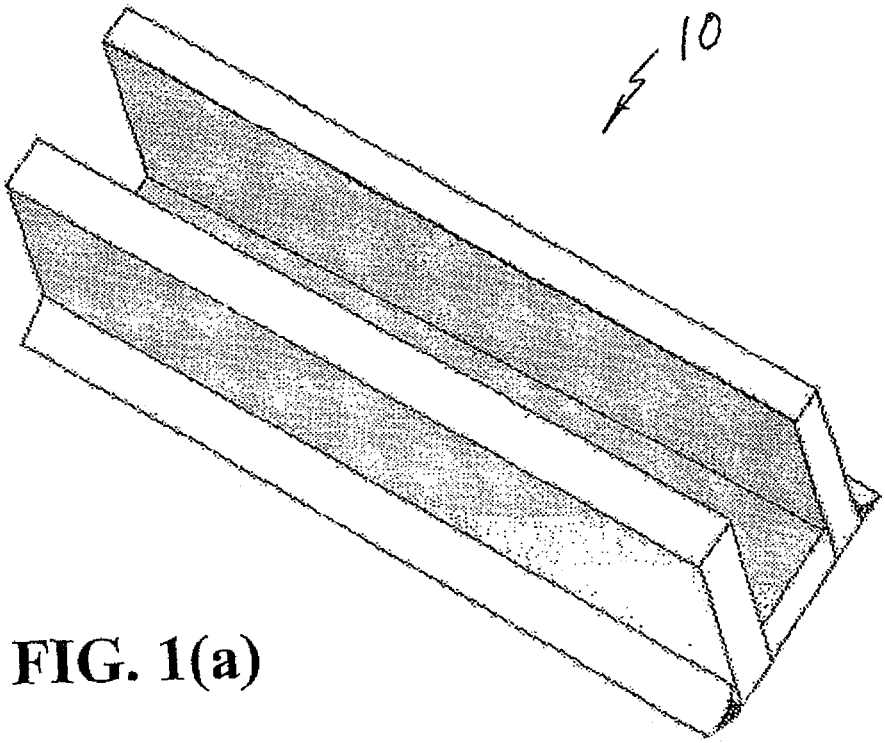
FIG. 1*a* is an enlarged view of the broom holder shown in FIG. 1.

Referring now specifically to the Figures in which similar or identical parts will be identified by the same reference numerals throughout, and first referring to FIGS. 1*a* and 1*b*, the broom holder in accordance with the invention is generally designated by the reference numeral 10.

The broom holder or broom caddy 10 includes a base 12 having a generally flat support surface 12*a* for resting on a floor or other horizontal surface. Two generally parallel walls 14, 16 extend from base 12 in a direction away from the support surface 12*a*, the walls being generally normal to the base 12. The walls 14, 16 are spaced from each other a distance generally corresponding to the width of a broom head and, together with the base 12, form an elongate space to receive a broom head and bristles as will be described. The parallel walls 14, 16 include means or structure for engaging and supporting the broom head and maintaining the broom in an upright orientation so that the broom handle is oriented in a generally vertical direction and at a height above the base 12 at least equal to the heights of the broom bristles. As best shown in FIG. 1*b*, when the broom is supported by the broom holder, the broom bristles are suspended when not in use without bending or flexing of the bristles.

Referring to FIG. 1, the elongate space 18 has a width "W", a length "L" and a height "H". In a presently preferred embodiment, W=5", H=5" and L=1'. The dimensions are selected to allow the broom head to slide into the broom holder. Preferably, the width of the base is greater than the corresponding spacing or width W between the walls 14, 16 to enhance the stability of the broom holder when supporting a broom.

As shown in FIG. 1, the broom holder 10 has a generally rectangular configuration that will accommodate a generally elongate broom head to be more fully described in connection with FIG. 1*b*. Preferably, the broom holder is made from a material selected from a group comprising wood and plastic. Any suitable plastic may be used for the broom holder and produced in a variety of colors and any suitable manufacturing processes. Additional manufacturing techniques may be used such as injection molding. The broom holder may also be made of wood, such as oak or poplar using conventional manufacturing processes including computer numerical controlled saws, shapers, routers, lathes, drills, etc. to produce consistent wood shapes and parts. A feature of the invention is to provide the broom holder with a means or structure that provides effective, safe and easy access to the broom including the removal of the broom from the broom holder for use or to restoring the broom holder to storage of the broom when no longer needed.

In FIG. 1*b* a broom is generally designated by a reference numeral 30. The broom 30 includes a head or block 32 provided with a neck 34 to which a handle 36 is secured. The specific manner by which the handle 36 is secured to the broom head 32 by means of the neck 34 is not critical although the connection may be a permanent one or the handle may be threadedly engaged with the neck 34 as is the case with many brooms.

Figure 2:
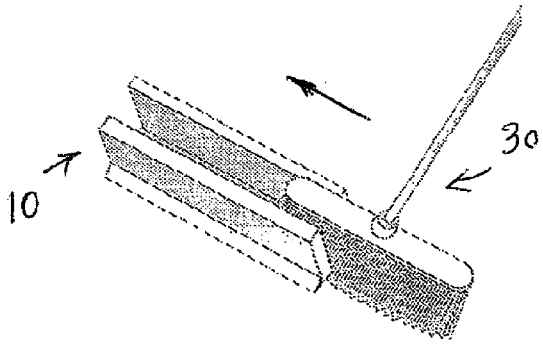
FIG. 2 is similar to FIG. 1 and illustrates how a broom can be placed into the broom holder from right to left.
Figure 4:
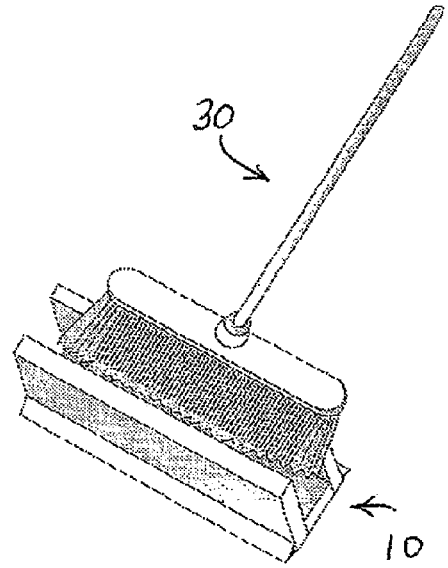
FIG. 4 illustrates how a broom supported by the broom holder can be removed or pulled out of the broom holder by raising it from bottom to top.
Figure 3:
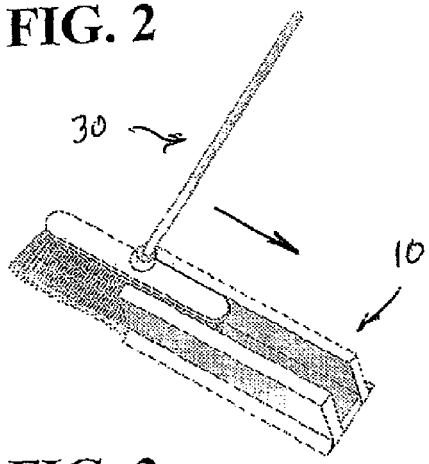
FIG. 3 is similar to FIG. 1 and illustrates how a broom can be placed into the broom holder from left to right.
Figure 5:
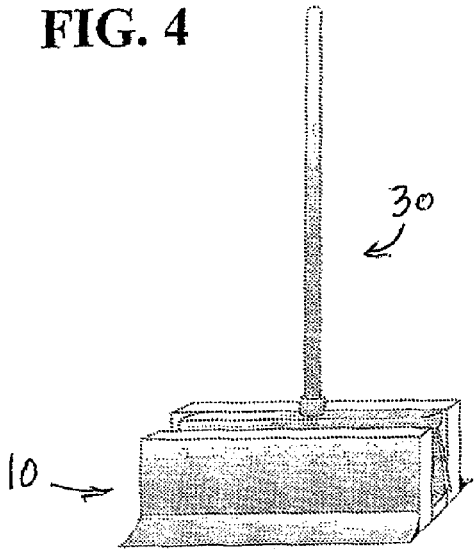
FIG. 5 illustrates the manner in which a broom is supported in a substantially vertical orientation when stored after use.
Figure 2A:
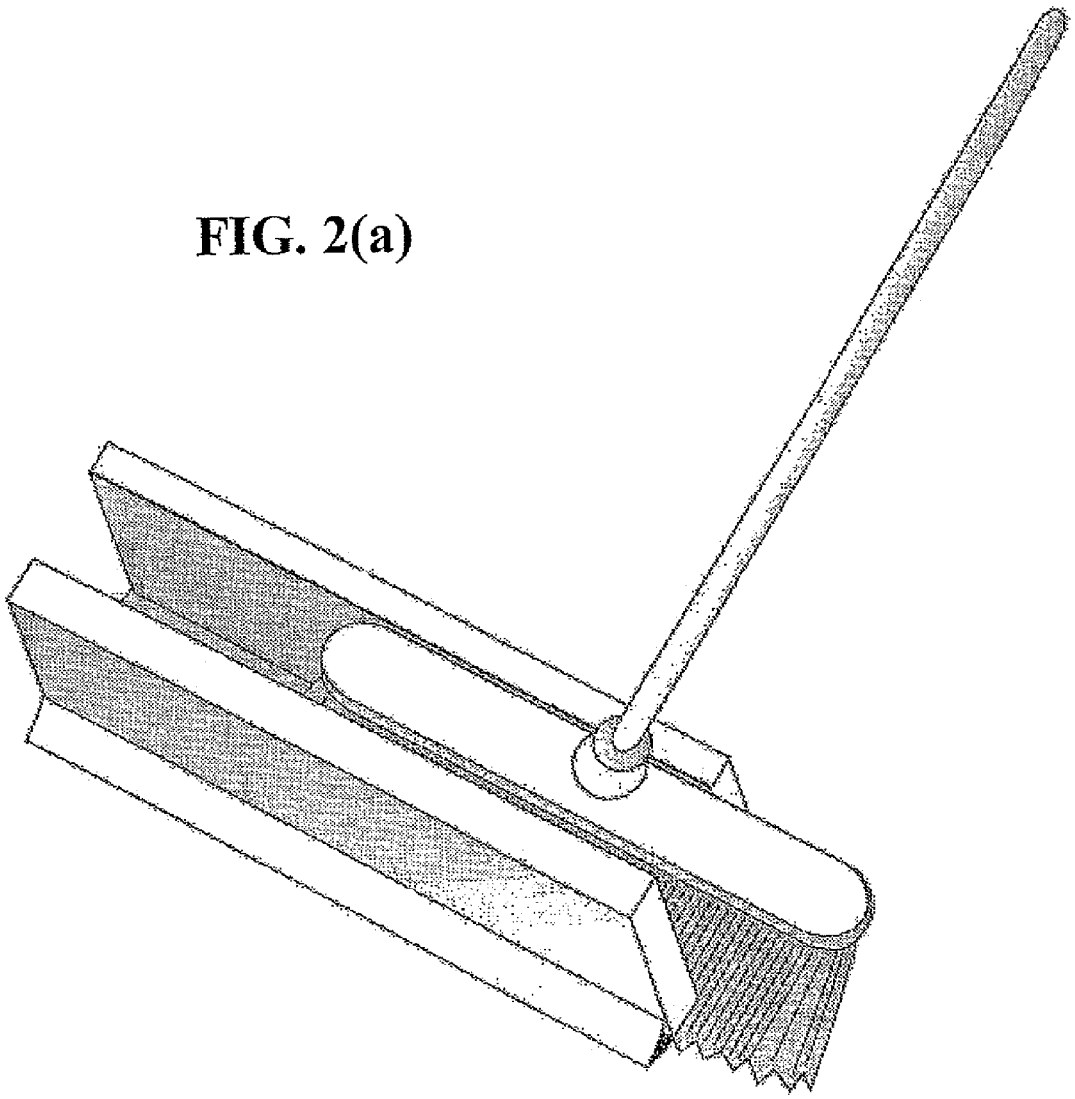
FIG. 2*a* is an enlarged view of FIG. 2.
Figure 3A:
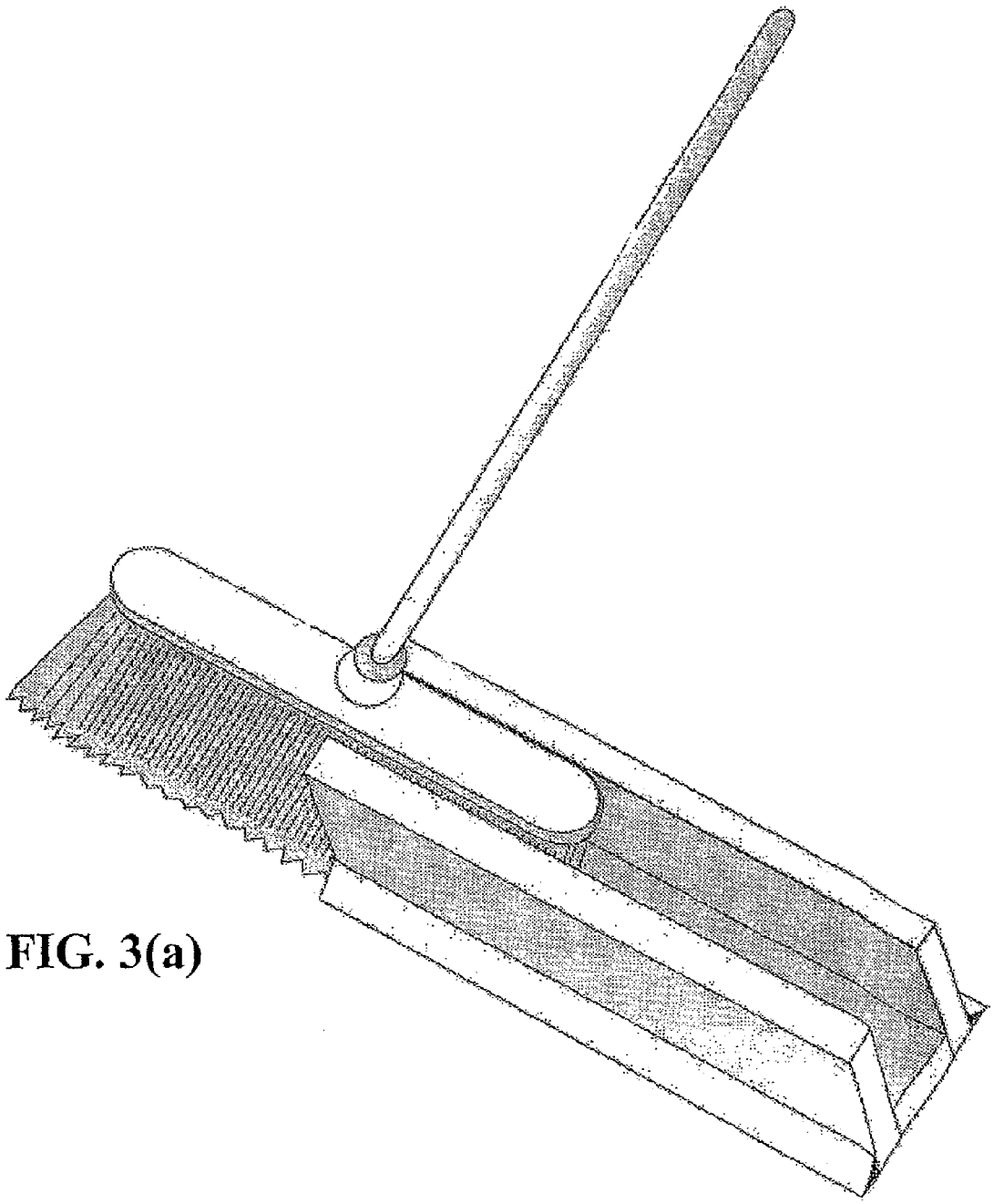
FIG. 3*a* is an enlarged view of FIG. 3.
Figure 4A:
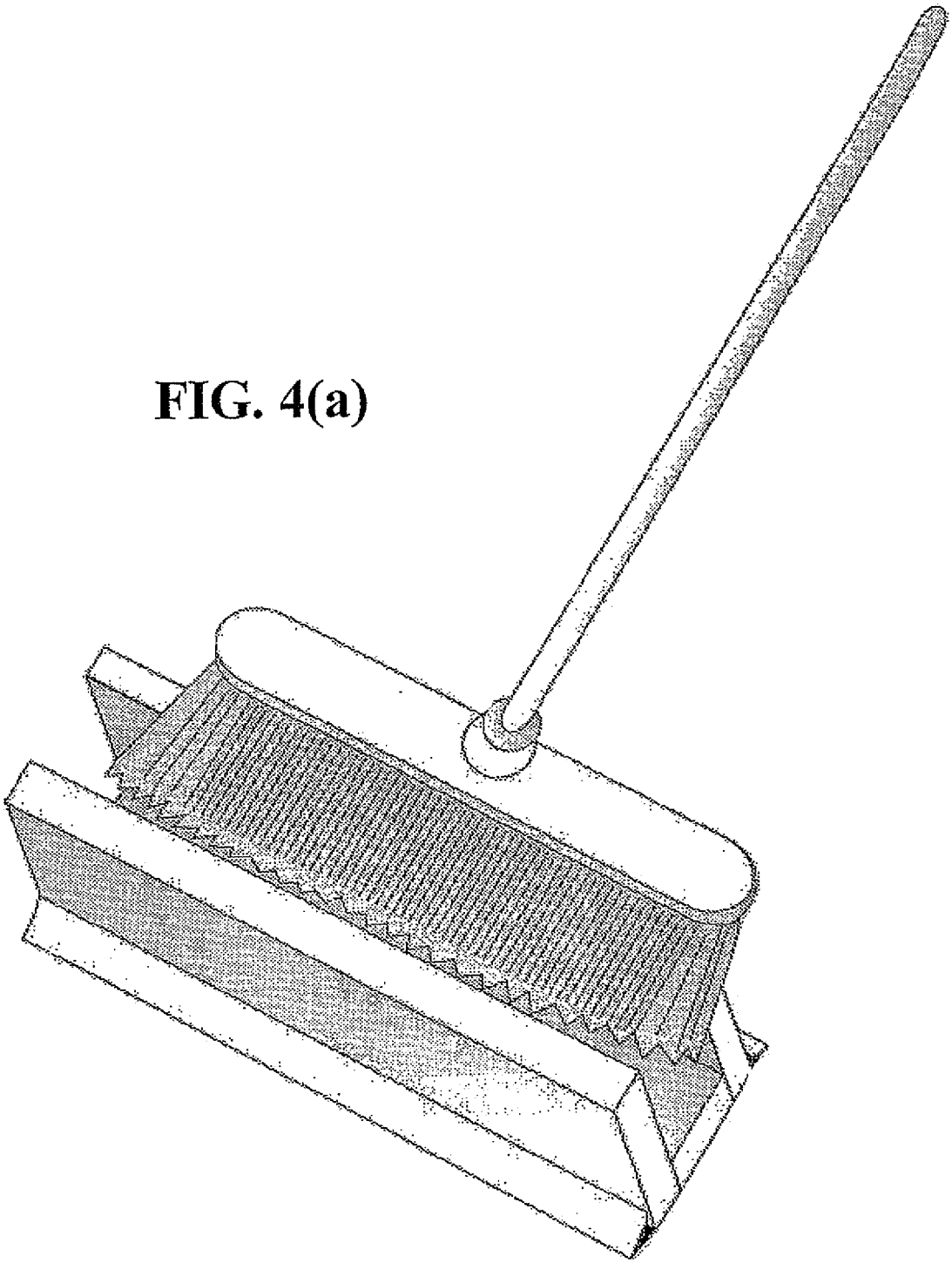
FIG. 4*a* is an enlarged view of FIG. 4.
Figure 5A:
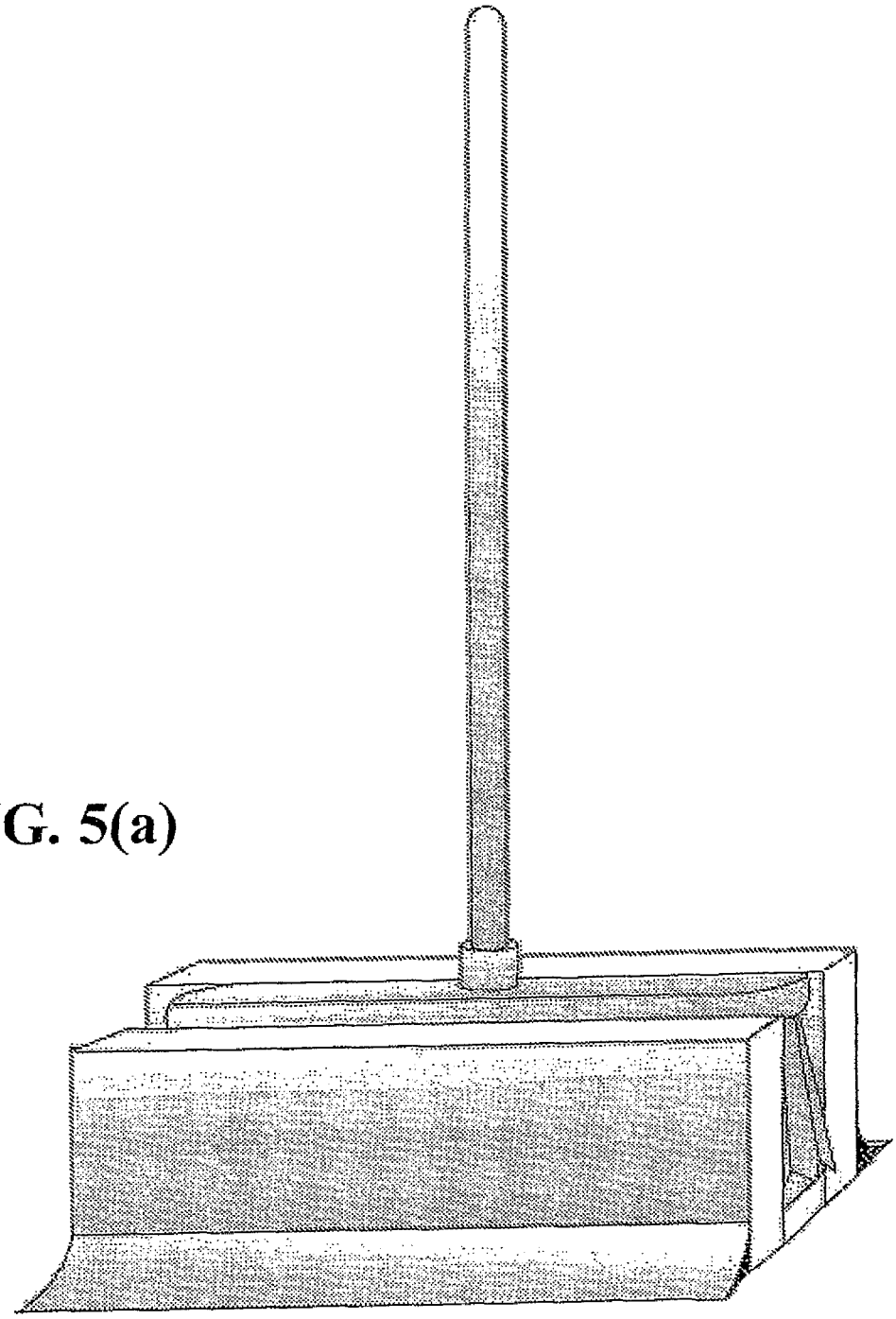
FIG. 5*a* is an enlarged view of FIG. 5.

The broom head or block 32 is generally elongated and shown to have a width "w" and length "l" generally being less than L. The width W of the elongate space or channel 18 is somewhat greater than of the broom head width w and selected to provide both support of the broom head while ensuring that the bristles 38 are sufficiently elevated so that they are in their natural straight condition. As shown in FIG. 1*b*, the bristles 38 remain straight and are not deformed, crushed or otherwise damaged. Preferably, the elongate space 18 is provided with lateral open sides 20*a*, 20*b* and a top opening 20*c* through which the broom 30 can move. The broom holder can have one lateral end, in which case the broom can be moved from right to left (as suggested in FIGS. 2 and 2*a*) or from left to right (as suggested in FIGS. 3 and 3*a*). In the preferred embodiment both, lateral ends 20*a*, 20*b* are open and, therefore, the broom can be inserted or removed through either lateral end. FIGS. 1*b* and 5 illustrate the manner in which the broom is supported in an upright orientation with the handle in a substantial vertical direction while the broom head 32 rests upon the shoulders 14*b*, 16*b* that form a slot or opening useful for supporting and sliding the broom head and the bristles into and out of the broom holder.

The present invention is a practical, neat, durable, space saving and attractive holder that can support a broom in a more effective, safe and easy to access manner. Such a broom storage unit or holder prevents the bristles on a broom from being bent or smashed or otherwise temporarily or permanently deformed as a result of resting the broom on the bristles on a floor especially over extended periods of time. This will prevent premature replacement and purchases of replacement brooms and save consumers money.

The broom holder of the invention can be packaged in cardboard pressboard box, sized for the product, assembled or disassembled. The box can be imprinted in one or more colors. A small pamphlet can be included in each package detailing instructions for assembling or installation. Corrugated cardboard shipping containers would be used to hold a quantity of individually packaged products to facilitate shipment and storage.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim that:

1. A broom holder for supporting a broom having a generally flat broomhead having opposing generally parallel edges and having a width and length and bristles having a predetermined length extending from one side of the broomhead an elongate handle extending from another side of said broomhead, the broom holder comprising a an elongate base with opposing lateral ends and having a generally flat support surface suitable for resting on a floor; and two generally parallel walls extending from said base in a direction away from and generally normal to said base and having equal wall widths at least equal to said width of said broomhead, said generally parallel walls being spaced from each other a distance generally corresponding to the width of the broomhead and form an elongate space having openings at said base lateral ends and a top opening to receive the broomhead and bristles, said parallel walls form interior uniform parallel surfaces across said widths of said parallel walls most remote from said base and spaced to be in close juxtaposed proximity to said parallel edges of the broomhead across said wall widths when placed within said elongate space for supporting the broomhead to maintain the broom in an upright orientation with the broom handle in a generally vertical direction, said base extending beyond said parallel walls in a direction transverse to said parallel walls to enhance stability to the broom holder when supporting a broom, whereby the broom can be supported when not in use by the juxtaposed surfaces of said parallel surfaces of said parallel walls and said parallel edges of said broomhead, whereby a broomhead placed between said parallel walls maintains a broom in an upright position in a plurality of positions of said broomhead relative to said elongate space to be fully received within said elongate space or partially projecting beyond said base lateral ends.

2. A broom handle as defined in claim 1, wherein said base has a width greater than a spacing between said walls to enhance stability to the broom holder when supporting a broom.

3. A broom handle as defined in claim 1, wherein the broom holder has a generally rectangular configuration.

4. A broom handle as defined in claim 3, wherein the broom holder is approximately 5 inches high, 1 foot long and 5 inches wide.

5. A broom handle as defined in claim 1, wherein the broom holder is made of a material selected from a group comprising wood and plastic.

6. A broom handle as defined in claim 1, wherein the broom holder is made of polystyrene.

7. A broom handle as defined in claim 1, wherein the broom holder is made of a wood selected from a group comprising oak and poplar.

8. A broom handle as defined in claim 1, wherein the broom holder is imprinted with at least one color.

9. A broom handle as defined in claim 1, wherein said elongate space has an upper open side and at least one open lateral side for to allow the broom head to be inserted into said elongate space through said at least one open side.

10. A broom handle as defined in claim 1, wherein said elongate space has two opposing open lateral sides to allow the broom to be inserted into said elongate space through either one of said two open lateral sides.

11. A combination of a broom and broom holder for supporting a broom having a generally flat broomhead having opposing parallel edges and having a width and length and bristles having a predetermined length extending from one side of the broomhead and an elongate handle extending from another side of said broomhead, the broom holder comprising a elongate base with opposing lateral ends and having a generally flat support surface suitable for resting on a floor; and two generally parallel walls extending from said base in a direction away from and generally normal to said base and having equal wall widths at least equal to said width of said broomhead, said generally parallel walls being spaced from each other a distance generally corresponding to the width of the broomhead and form an elongate space having openings at said base lateral ends and a top opening to receive the broomhead and bristles, said parallel walls form interior uniform parallel surfaces across said widths of said parallel walls most remote from said base and spaced to be in close juxtaposed proximity to said parallel edges of the broomhead across said wall widths when placed within said elongate space for supporting the broomhead to maintain the broom in an upright orientation with the broom handle in a generally vertical direction, said base extending beyond said parallel walls in a direction transverse to said parallel walls to enhance stability to the broom holder when supporting a broom, whereby the broom can be supported when not in use by the juxtaposed surfaces of said parallel surfaces of said parallel walls and said parallel edges of said broomhead, whereby a broomhead placed between said parallel walls maintains a broom in an upright position in a plurality of positions of said broomhead relative to said elongate space to be fully received within said elongate space or partially projecting beyond said base lateral ends.

12. The combination as defined in claim 11, wherein the broom holder has a generally rectangular configuration.

13. The combination as defined in claim 11, wherein the broom holder is made of a material selected from a group comprising wood and plastic.

14. The combination as defined in claim 11, wherein the broom holder is made of a wood selected from a group comprising oak and poplar.

15. The combination as defined in claim 11, wherein said elongate space has two open lateral sides to allow the broom to be inserted into said elongate space through either one of said two open lateral sides.

16. The combination as defined in claim 11, wherein said broom head is provided with curved surfaces at lateral ends thereof to facilitate insertion of the broom head into said broom holder.

* * * * *